United States Patent [19]

Brunner

[11] Patent Number: 4,711,155

[45] Date of Patent: Dec. 8, 1987

[54] HYDRAULIC CONTROL DEVICE

[75] Inventor: Rudolf Brunner, Baldham, Fed. Rep. of Germany

[73] Assignee: Heilmeier & Weinlein Fabrik fur Oel-Hydraulic GmbH & Co. KG, Munich, Fed. Rep. of Germany

[21] Appl. No.: 916,171

[22] Filed: Oct. 7, 1986

[30] Foreign Application Priority Data

Oct. 10, 1985 [DE] Fed. Rep. of Germany ..... 3536219

[51] Int. Cl.[4] ..... F15B 13/044

[52] U.S. Cl. ..... 91/446; 91/452

[58] Field of Search ..... 91/446, 452

[56] References Cited

U.S. PATENT DOCUMENTS 3,437,012 4/1969 Bjorklund ..... 91/446

FOREIGN PATENT DOCUMENTS 3233046 3/1984 Fed. Rep. of Germany .

OTHER PUBLICATIONS

Leaflet D 7177 "Stromregelventile", Jan. 1985, of Heilmeier & Weinlein, Munich.

*Primary Examiner*—Gerald A. Michalsky

*Attorney, Agent, or Firm*—Kinzer, Plyer, Dorn, McEachran & Jambor

[57] ABSTRACT

A hydraulic control device for a hydraulic motor having a working pressure line connecting a source of pressure with the motor and containing a non-return valve from which a bypass line branches off to communicate with the fluid reservoir or tank; a three-way flow controller is connected to the tank and is in communication with a two-way flow controller; characterized in that a single measuring orifice is common to several pressure balances with a single porportional magnet provided in the working pressure line.

17 Claims, 4 Drawing Figures

FIG.1
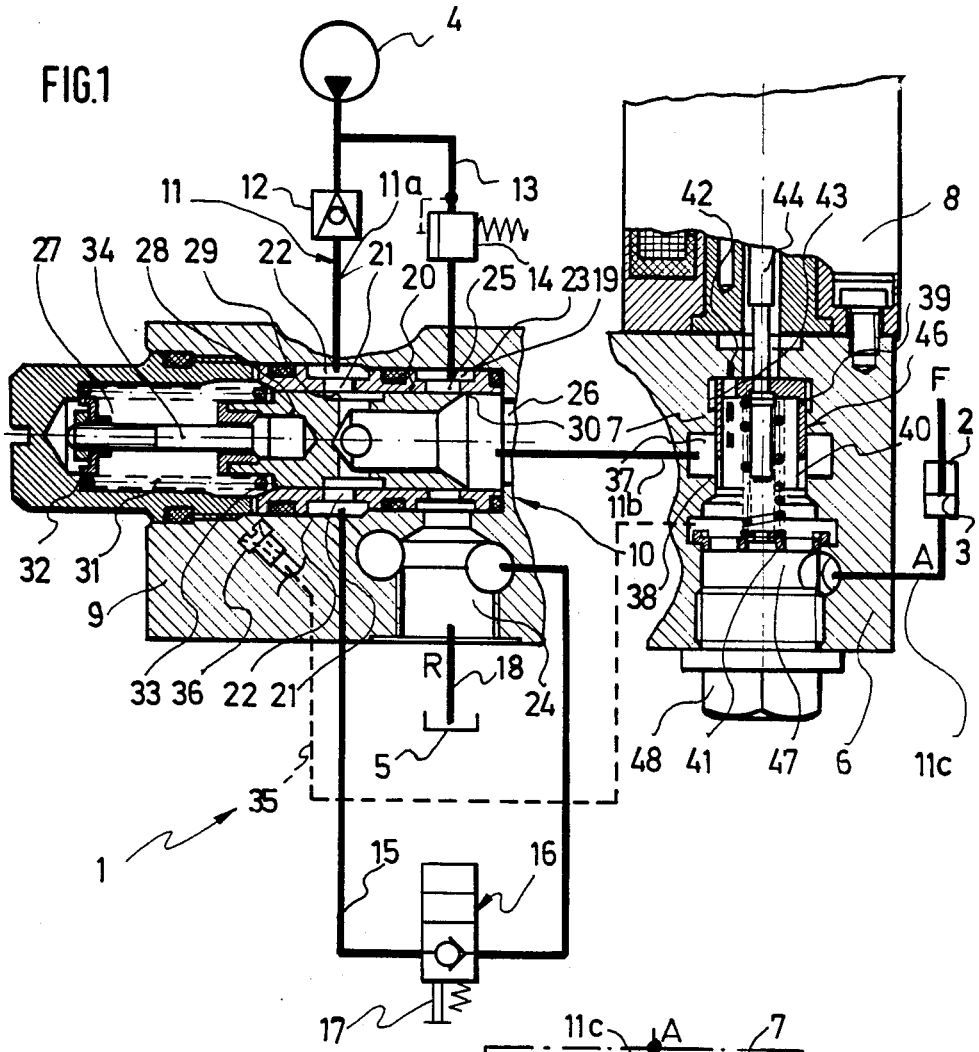
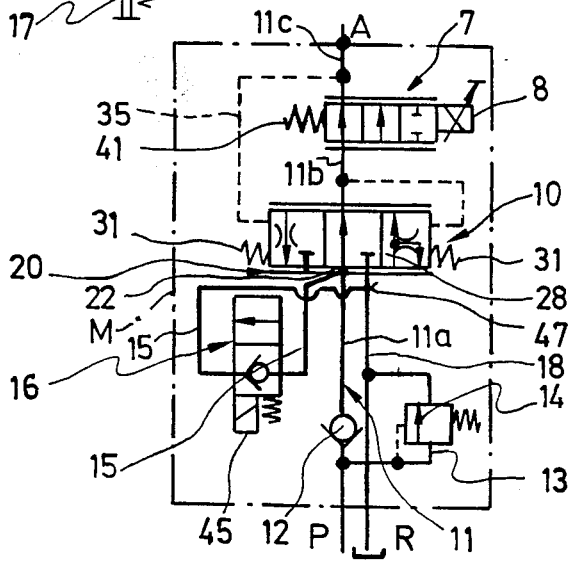
FIG.2

2
53
54
62
7
22
55
8
50
15'
60
57
59
10'
56
1'
58
11
12
63
52
51
61
64
4
5

HYDRAULIC CONTROL DEVICE

BACKGROUND OF THE INVENTION

The invention relates to a hydraulic control device of the type indicated in the precharacterizing part of claim 1.

In a control device of this type known from practice, e.g. for the lifting cylinder of a stacker truck, the three-way flow controller with its measuring orifice is disposed in the working pressure line and in the direction of flow to the hydraulic motor before the non-return valve. The bypass line bypasses the non-return valve and is moreover connected to the control outlet of the three-way flow controller. The two-way flow controller with its measuring orifice is located in the bypass line. The mentioned flow controllers distinguish themselves by the fact that they keep the amount of pressure fluid directly constant as a function of the flow influence of the proportional magnet of the measuring orifice independently of the load on the hydraulic motor and allow the sensitive change of the speed of the hydraulic motor, again independently of the load by a change of the flow influence of their proportional magnet. Such flow controllers are e.g. shown and described in the leaflet D 7177 "Stromregelventile", January 1985, of Heilmeier & Weinlein, 8 Munich 80. Their expensive and complex construction is disadvantageous in the known control devices, in which two expensive proportional magnets with their measuring orifices are necessary, which must be electrically excitable independently of each other.

A control device was developed with the attempt of getting away from the high constructional expenditure as it is known from the DE-OS No. 32 33 046, FIG. 1. In this control device a two-way flow controller with a measuring orifice being actuated by a single proportional magnet is only provided in the bypass line to the tank. The flow controller influences the amount of pressure fluid flowing from the pressure source to the hydraulic motor or from the hydraulic motor into the tank by discharging in each case an amount of pressure fluid depending on the flow influence on the proportional magnet into the tank. The serious disadvantage ensues from this that the amount of pressure fluid passing through the flow controller is constant to the influence of flow on the proportional magnet, that, however, the amount of pressure fluid flowing to the hydraulic motor is no longer proportional to the influence of flow on the proportional magnet. The pressure source is in such cases of application a pump only running during load upon operation of the hydraulic motor, which is driven by a shunt electric motor, in which the amount conveyed per time unit is changed with increasing counter-pressure. The two-way flow controller cannot compensate for these changes towards the tank, which means that the hydraulic motor operates more slowly with increasing load and gets faster with decreasing load. This is undesired in practice where a sensitive speed control is of importance. Moreover an undesired switching jerk occurs during starting.

SUMMARY OF THE INVENTION

The invention is based on the problem to create a control device of the type mentioned at the beginning, which excels by a reduced constructional expenditure and by a load-independent speed control of the hydraulic motor in both directions. In this design a second proportional magnet and a second measuring orifice is omitted, because the single measuring orifice with its proportional magnet cooperates either with the three-way or with the two-way flow controller as a function of the selected direction of movement of the hydraulic motor. Since only a single proportional magnet must be driven, the control expenditure is also reduced. The control device operates independently of the load, because the three-way flow controller conducts the amount of pressure fluid predetermined by the proportional magnetic to the hydraulic motor independently of the counter-pressure produced by the load upon the operation of the hydraulic motor against the load and varies the amount of pressure fluid carried off for run-back. The changes of the amount conveyed by the pressure fluid pump under load are thus compensated for by the three-way flow controller. The speed of the hydraulic motor can be sensitively controlled. The same applies to the operation of the hydraulic motor under the load, because the two-way flow controller maintains independently of the load the respective speed adjusted by means of the proportional magnet, i.e. in the case of higher load it lets flow less pressure fluid into the run-back than in the case of smaller load. In this fashion the load-dependent conveying behaviour of the pressure fluid pump is compensated for with only one proportional magnet.

In one embodiment by having the shut-off valve saving a separate load holding valve thus prevents that upon the actuation of the three-way flow controller the pressure fluid flows off. The two pressure balances do not hinder each other despite the common measuring orifice, because the one only operates if the pressure is higher before the measuring orifice than behind it, whereas the other one only operates at reversed pressure conditions.

So that the operation of the three-way flow controller is not impaired in the case of a closed shut-off valve, an embodiment is possible in which there is a free flow communication from the control outlet of the three-way flow controller to the tank despite shut-off bypass line.

A further important idea is contained in claim 4. This embodiment excels by a compact construction, in which the control piston has a double function, since it forms both the pressure balance for the three-way flow controller and the pressure balance for the two-way flow controller. It is used for the control of the two pressure balances that the pressure before the measuring orifice must be higher in the case of the movement of the hydraulic motor against the load than it is behind the measuring orifice, whereas the pressure behind the measuring orifice is higher than before the measuring orifice in the case of the hydraulic motor moved under the load.

A constructionally simple embodiment is one in which the pump inlet duct undertakes with the lateral inlet of the control piston the supply of pressure fluid to the control orifice of the three-way flow controller, which is formed by the control edge of the control piston and the tank connection, whereas the lateral inlet undertakes together with the pump inlet duct the function of the control orifice in the case of the operation of the two-way flow controller. The feature of a double acting spring assembly contributes furthermore to the constructional simplification, because the springs required for the operation of the pressure balances in opposite direction in both directions are combined in a spring assembly.

The feature furthermore suitable is having a magnetically actuated shut-off valve coupled in control engineering respect with the proportional magnet of the measuring orifice. A further embodiment of the invention is one in which the pressure balance of the two-way flow controller can be used, because the pressure balance undertakes a directional or control function for these operating conditions, whereas the control function is turned off. This has also the advantage that the switching jerk upon the starting in the one or the other direction of movement of the hydraulic motor does not take place, because no significant volumes of pressure fluid flow off during the maintaining of the pressure in the pressure balance, which would have to be compensated for when starting the movement of the hydraulic motor. The additional function of the pressure balance of the two-way flow controller is of special importance in view of the constructional simplification of the control device.

The optionally switchable directional or control function of the pressure balance according to claim 9 can be achieved in simple fashion. As soon as the side of the pressure balance at which the same can be acted upon in the direction of opening is relieved from pressure, the pressure active on the other side of the pressure balance brings the pressure balance into its shut-off position, which it maintains reliably also over longer load holding periods, because no counter-pressure acting in the direction of opening of the pressure balance can be formed. In constructional respect the latter object can be achieved especially easily with a $\frac{2}{3}$ way valve which is small and inexpensive as a seat valve in the control line and almost leakage-loss-free. It only must process small amounts of pressure fluid.

A further, especially important idea is expressed as follows. In control devices, in which the hydraulic motor can be driven up to against a rigid stop, an operating condition could occur, in which the working pressure line becomes almost completely pressureless. When using the pressure balance as load holding valve this would have the effect that the pressure acting in the direction of closing of the pressure balance would be reduced that much so that the spring acting in the direction of opening could open the pressure balance. If it would be attempted again to move the hydraulic pressure and to build up pressure in the working pressure line, the pressure fluid could flow off unhinderedly through the pressure balance being in the open position. The biasing valve counters this disadvantage, which prevents the decrease of the pressure in the working pressure line up to below the opening pressure of the pressure balance. The biasing valve is not necessary in control devices in which the aforementioned operating condition cannot occur.

In constructional respect the aforementioned object can be achieved especially easily with the embodiment variants employing a spring-loaded biasing valve together with a 2/2-way seat valve with magnetic actuation or a spring-loaded sliding valve acted upon with control pressure.

Of further importance is the construction in which the $\frac{2}{3}$-way seat valve can be switched into a shut-off position advancing the closing position of the measuring orifice, because with it the possibility is created to effect the stopping of the hydraulic motor with the directional or control function of the pressure balance and to switch off its control function. This has the advantage that the measuring orifice can be released from this task so that the hydraulic motor so-to-speak runs at standstill against the pressure balance. Thus also a possibly occurring stopping jerk is avoided, which leads in connection with the other measures bringing about a jerk-free starting to an almost ideal control of the movement of the hydraulic motor.

A further suitable example of embodiment is one where the lifting module component requires only little space for its accommodation and contains all components for the troublefree operation in combined fashion. A control device so far operated with conventional control means can be converted with little effort, because the lifting module component can have substantially the same connections and connection diagrams as the conventional control means.

BRIEF DESCRIPTION OF THE DRAWING

FIG. 1 shows a control device with flow control elements represented in longitudinal sections.

FIG. 2 shows in symbolic representation a lifting module component equipped with the elements of FIG. 1.

DESCRIPTION OF THE PREFERRED EMBODIMENTS

Figure 3:
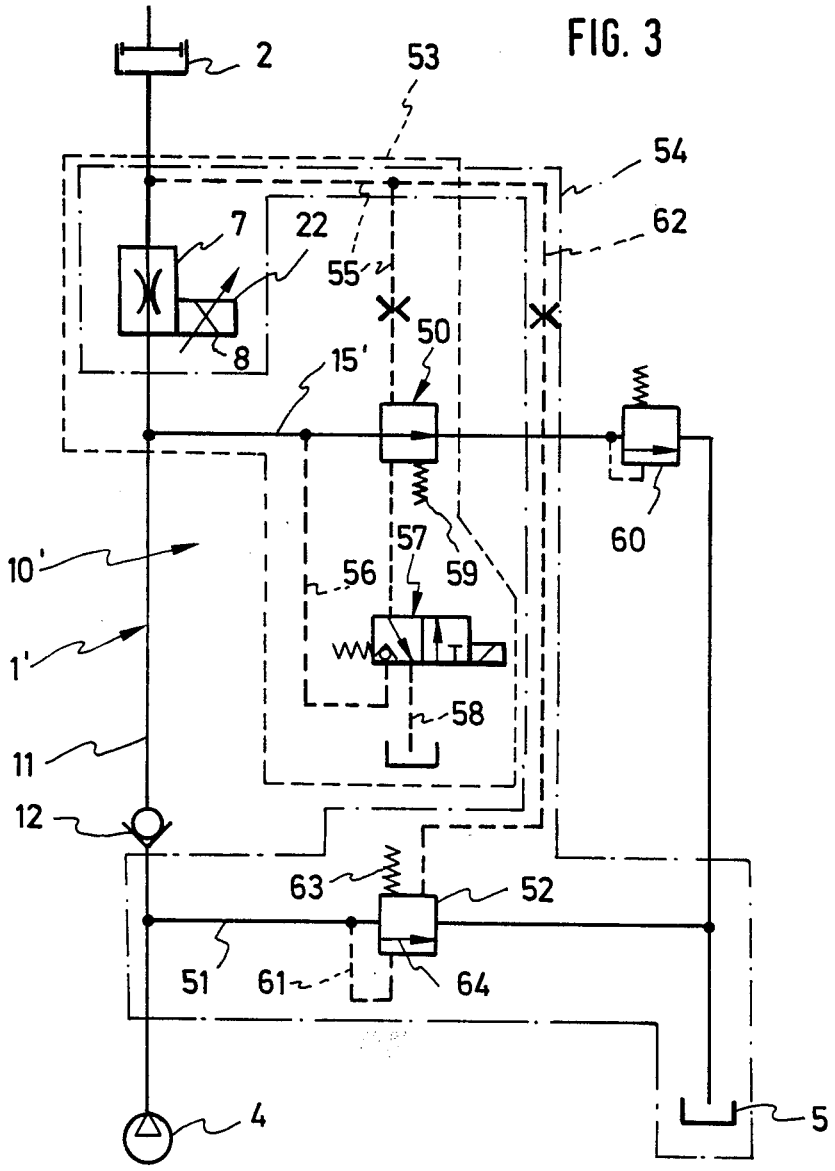
FIG. 3 shows a modified embodiment of a control device as block diagram.

A hydraulic control device 1 according to FIG. 1 is part of a lifting device not represented in more detail, e.g. of a stacker truck and serves for actuating a hydraulic motor 2, e.g. a simply acting hydraulic cylinder with a piston 3 which can be extended against a load F and can be retracted under the action of the load F. A pressure source 4, e.g. a pump driven by a shunt electric motor, is provided for actuating the hydraulic motor 2, which conveys pressure fluid from a tank 5. A measuring orifice 7 is disposed in a housing 6, which is actuated by a proportional magnet 8, viz. proportionally to an electrical signal (control current), which can be varied in the control range according to an optional profile. In a housing 9 either combined with the housing 6 or separated from it a pressure balance assembly 10 with two pressure balances is furthermore provided. The measuring orifice 7 forms together with the pressure balance assembly 10 connected before it a three-way flow controller and a two-way flow controller, the three-way flow controller being provided for controlling the speed of the hydraulic motor 2 against the load F and the two-way flow controlling being provided for controlling the speed of the hydraulic motor 2 under the load F.

The pressure source 4 is connected to the hydraulic motor 2 via a working pressure line 11, which consists of three successive line sections 11*a*, 11*b*, 11*c*. The first line section 11*a* is connected to the housing 9 and contains a non-return valve 12 opening into the direction of flow to the hydraulic motor 2. In a parallel line 12*a* branching off from the line section 11*a* to the housing 9 for limiting the maximum system pressure a pressure relief valve 14 is provided. A bypass line 15 branches moreover off in the housing 9 in an annular duct 22 from the line section 11*a*, in which a two-position shut-off valve 16 is arranged, which can be switched e.g. at 17 by means of a magnet (not shown) from the drawn shut-off position into a passage position against spring pressure. The bypass line 15 leads to a connection bore 24 in the housing 9 and is connected like the parallel line 13 to the tank 5 via a tank line 18. A control bushing 20 is determined in the housing 9 in a housing chamber 19, which comprises a pump inlet duct 21 in the form of several bores distributed in circumferential direction and the annular duct 22 at the outer circumference, to which the line section 11*a* is connected at one side and the bypass line at the other side. A further outer annular duct 23 is furthermore provided in the control bushing 20 at a distance to the annular duct 22, from which tank connections 25 distributed across the circumference lead to the interior of the control bushing 20. The annular duct 23 is connected to the line 18 and the tank via the connection bore 25.

The side of the housing chamber 19, which is adjacent to the tank connection 25, is connected to the housing 6 of the measuring orifice 7 via the second line section 11*b*. The side 27 of the housing chamber 29 which does not face the tank connection 25 is separated from the side 26 by a control piston 28 belonging to both pressure balances, the control piston 28 being sealingly displaceable in the control bushing 20.

The control piston 28 is in its basic position in FIG. 1 in which it is aligned with a lateral inlet 29, which is e.g. an annular duct, to the pump inlet duct 21. The inlet 29 is in communication with the interior of the control piston 18, i.e. with the side 26 of the housing chamber 19. The control piston 28 has a continuous control edge 30 in the area of the tank connection of the control bushing 20. In the represented basic position the control piston 28 covers the tank connection 25 sealingly. A spring 31 is disposed in the side 27 of the housing chamber 19, which is supported between spring abutments 32 and 33 and is connected to the control piston 28 via a pull bar 34. Both spring abutments 32 and 33 are supported in the housing 9 and can be lifted off to each side in the case of a movement of the control piston 28 from its basic position, so that the control piston 28 must be displaced in both directions of movement against the force of the spring 31. A control line 35 leads from the side 27 of the housing chamber 19 to the measuring orifice 7 through a throttle 36.

The measuring orifice has an annular duct 37 in the housing 6, which is connected to the side 26 of the housing chamber 19 of the pressure balance assembly 10 via the second line section 11b. The annular duct 37 belongs to a housing bore 46 and is separated from a bore section 47 by a control edge 38. An orifice piston 39 is sealingly displaceable in the housing bore 46, which is provided with triangular notches 40 in its lower edge area, which form the actual measuring orifice with the control edge 38. A spring 41 loads the orifice piston 39 in the upward direction into the final position shown in FIG. 1. A pin 42 is provided as mechanism to prevent rotation for the orifice piston 39, which submerges into a through bore 43 via which the pressure below the orifice piston 39 is transmitted to the other side so that the orifice piston 39 is pressure compensated. An actuation pin 44 of the proportional magnet 8 engages at the orifice piston 39, which is designed in such fashion that it pushes the orifice piston 39 into a lower and shut-off position upon excitation, in which the lower end 44 of the actuation pin rests on a stop. A bore section 47, from which the third line section 11c leads to the hydraulic motor 2 is connected to the side 27 of the housing chamber 19 via the control line 35 and closed towards the exterior by means of a sealing plug 48.

FIG. 2 shows in symbolical representation the construction of the essential components of the control device 1 of FIG. 1, these components forming a lifting module component M, which contains in and at a housing all cooperating components and also the actuation magnet 45 for the shut-off valve in the bypass line 15.

The control device operates as follows:

According to FIGS. 1 and 2 the control device is in its passive position; both the proportional magnet 8 and the actuation magnet 45 are de-energized. The measuring orifice 7 is completely open. The shut-off valve 16 is closed. The pump 4 stands still. A load F resting on the piston 3 is received by the non-return valve 12 on the one hand and by the shut-off valve 16 on the other hand. Since the measuring orifice 7 is open, the same pressure prevails at both sides of the control piston 28 so that the same remains in the represented basic position.

The proportional magnet 8 is completely energized to lift off the load F; the orifice piston 39 moves downwardly; the control orifice 7 is closed. The pump 4 starts at the same time. The shut-off valve 16 remains in the shut-off position. The flow of pressure fluid coming from the pump 4 in the line section 11*a* is divided into partial flows flowing on the one hand via the line sections 11*b*,11*c* and the measuring orifice 7 to the hydraulic motor 2 and on the other hand via the control orifice 25, 30 and the tank line 18 to the tank 5. The size of the partial flow flowing to the hydraulic motor 2 results from the pressure balance, in which the difference in pressure across the measuring orifice 30, 25 is equal to the difference in pressure across the measuring orifice 7 plus the pressure generated by the load F. The cross-section of the measuring orifice 7 is preselected by the proportional magnet 8. The difference in pressure above the measuring orifice 7 generates a force directed towards the left in FIG. 1 at the control piston 28, which displaces it against the force of the spring 31 until the difference in pressure necessary for the aforementioned pressure balance appears at the control orifice 25, 30. If the load is thereafter changed, then the partial flow through the control orifice 30, 25 would be changed in the case of an unchanged position of the control piston 28, which would also result in a change of the partial flow flowing across the measuring orifice 7 and thus in the difference in pressure across the measuring orifice 7. The equilibrium of forces at the control piston 28 disturbed by this forces the same however into a new control position, in which the difference in pressure across the control orifice 25, 30 is adapted so much that the aforementioned pressure balance and the sizes of the partial flows are maintained. In the cycle of the control piston 28 the pressure prevailing in the direction of flow to the hydraulic motor 2 in the line section 11*b* before the measuring orifice 7 acts in the annular chamber 37 and at the side 26 of the housing chamber 19, whereas the pressure prevailing behind the measuring orifice 7 in the bore section 47 and in the line section 11*c* acts on the other side 27 of the housing chamber 19 together with the force of the spring 31 on the control piston 28. The partial flow flowing to the hydraulic motor 2 through the line section 11c is also kept constant if the pump 4 decreases its conveying capacity or reduces its conveying capacity due to the counter-pressure. Then correspondingly less pressure fluid flows into the tank via the control orifice 25,30 and the line 18, so that the hydraulic motor 2 receives the unchanged partial flow. The triangular notches 40 of the orifice piston 39 ensure a constant or linear control characteristic thanks to their interplay with the control edge 38.

If the proportional magnet 8 is fully excited to stop the hydraulic motor 2 until the orifice piston 39 goes into its lower locking position and blocks the measuring orifice 7, then either the pump 4 is simultaneously switched off or its conveyed flow is completely discharged into the tank via the then completely open control orifice 25, 30 and the tank line 18. The load is held by the non-return valve 12 and the shut-off valve 16.

If a certain load F must be lowered at a determined speed, the pump 4 is first of all switched off and the shut-off valve 16 in the bypass line 15 is switched into its passage position, the proportional magnet 8 being fully excited. The excitation of the proportional magnet 8 is reduced in accordance with the desired speed. The flow of pressure fluid displaced by the hydraulic motor 2 by the load F flows via the measuring orifice 7 to the right side 26 of the housing chamber 19 and from there through the control orifice 21, 29 being formed into the bypass line 15, through the shut-off valve 16 and the tank line 18 to the tank 5. Due to the difference in pressure existing across the measuring orifice 7 the pressure before the measuring orifice (bore section 47) is higher than the pressure in the annular chamber 37 so that the control piston 28 is displaced towards the right in FIG. 1 and the pump inlet ducts 21 form a control orifice with the lateral inlets 29. The size of the pressure fluid flow to the tank 5 results from the pressure balance, in which the pressure effected by the load is equal to the difference in pressure across the measuring orifice 7 plus the difference in pressure across the control orifice 21, 29. The control piston 28 is placed that much towards the right as a function of the preselected position of the proportional magnet 8, until the necessary difference in pressure across the measuring orifice 7 and thus also the pressure fluid flow to the tank 5, i.e. the speed of the hydraulic motor 2, remain constant for the aforementioned pressure balance at the control orifice 21, 29.

If the hydraulic motor 2 is stopped, i.e. the proportional magnet is fully excited and the measuring orifice 7 is closed, then the shut-off valve 16 is simultaneously also brought into the locking position so that the load is held by the shut-off valve 16 and by the non-return valve 12.

It is furthermore conceivable that upon the putting into operation of the control device the proportional magnet 8 is automatically fully excited and the measuring orifice 7 is closed.

The measuring orifice 7 could also be disposed in the working pressure line in the direction of flow to the hydraulic motor 2 before the pressure balance assembly 10. The function would be the same. The shut-off valve 16 could also be another control element which can be brought from a locking position into a passage position. All components, i.e. also the non-return valve 12 and the pressure relief mechanism 14 and the shut-off valve 16, are combined in the represented embodiment (FIG. 2) in a lifting module element housing which contains also the pressure balance assembly 10 and the measuring orifice 7. This has constructional advantages.

Figure 4:
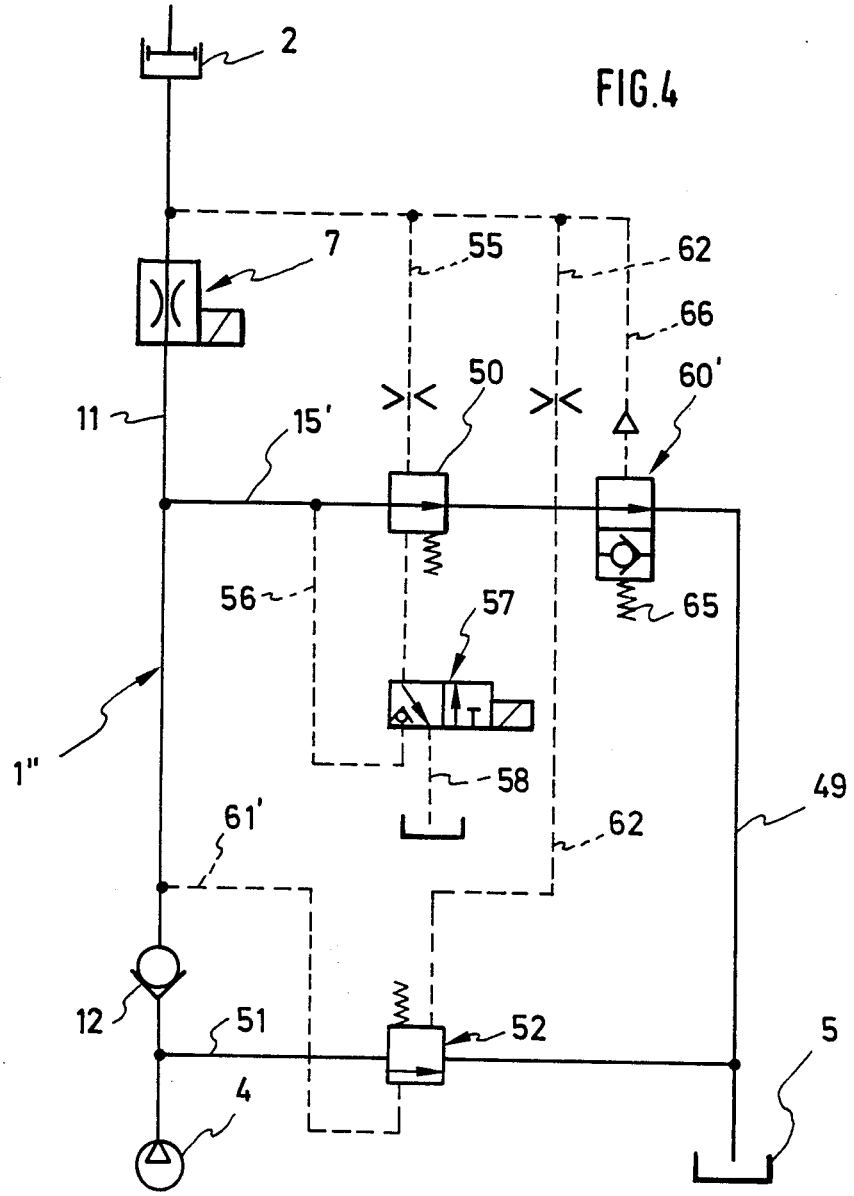
FIG. 4 shows a further modified embodiment.

FIG. 4 reveals a modified hydraulic control device 1', which has a similar structure as the control device 1 according to FIGS. 1 and 2. The pressure balance assembly 10' is different, because the one pressure balance 53 forming the two-way flow controller with the measuring orifice 7 is disposed with the control orifice 50 in the first bypass line 15' to the tank 5, whereas the other pressure balance 54 forming the three-way flow controller together with the measuring orifice 7 is disposed with its control orifice 52 in a second bypass line 51 branching off before the non-return valve 12 from the working pressure line 11 to the tank. The two control orifices 50 and 52 are driven oppositely to each other, i.e. the control orifice 50 of the pressure balance 53 is acted upon in the closing direction via the control line 55 by a control pressure drawn off between the measuring orifice 7 and the hydraulic motor 2 and in the direction of opening via a control line 56 by a control pressure drawn off between the non-return valve 12 and the measuring orifice 7 and the force of a spring 59, whereas the measuring orifice 52 of the other pressure balance is acted upon in closing direction by the force of a spring 63 and a control pressure drawn off between the measuring orifice 7 and the hydraulic motor 2 and transmitted via a control line 62 and in the direction of opening by a control pressure drawn off from the bypass line 51 via a control line 61 The control piston provided at the control orifice 52 is indicated with 64. A $\frac{2}{3}$ way valve 57 is provided in the control line 56, which is suitably a seat valve and interrupts the control line 56 in the indicated shut-off position and relieves the side of the control orifice 50, at which its control piston is acted upon in the direction of opening via a line 58 to the tank. In the other positions of the valve 57 the tank line 58 is separated and the passage through the control line 56 is free. It is possible with the $\frac{2}{3}$ way valve 57 to allocate a directional or control function to the pressure balance 53 or the control orifice 50 and to switch off the control function optionally; this has the advantage that in the case of the directional or control function the control orifice 50 remains in or adopts the shut-off position irrespective of the fact how the measuring orifice 7 is adjusted. In this fashion the pressure of the load can be held in the working pressure line 11 without an additional load holding valve. Because the pressure in the control line 62 is higher during the holding of a load than in control line 61 and because the force of the spring 63 at the control orifice 52 is moreover active in the direction of closing, the control orifice 52 is also reliably in the shut-off position during load holding so that the part of the working pressure 11 located before the non-return valve 12 is not arbitrarily relieved from pressure.

A biasing valve 60 is provided in the first bypass line 15' downstream behind the control orifice 50, which is adjusted to a biasing pressure which is higher than the opening pressure of the control orifice 50 predetermined by the force of the spring 59, viz. for the case that the piston 3 of the hydraulic motor 2 can be driven to the stop so that the pressure in the working line 11 could possibly decrease below the opening pressure of the control orifice 50 and the same could adopt its opening position in uncontrolled fashion. In the case of a renewed starting of the pump, the pressure fluid would then flow off unhinderedly through the open control orifice 50 and the hydraulic motor would not start its running movement.

In the embodiment of the control device 1'' according to FIG. 4 the control line 61' is connected behind the non-return valve 12 in the direction of flow as opposed to the embodiment of FIG. 3 and the biasing valve 60' is controlled as a function of the pressure between the measuring orifice and the hydraulic motor 2 via a control line 66 hydraulically against a spring 65, which is designed so strongly that it brings the biasing valve 60' automatically into the shut-off position as soon as the pressure in the control line 66 decreases below the opening pressure of the control orifice 50 of the pressure balance. The biasing valve 60' may be designed in the manner of a spring-loaded slide. It would furthermore be conceivable to provide an actuation magnet instead of the pressure precontrol via the control line, which is de-energized upon the decrease of the pressure.

The control devices 1' and 1'' work as follows:

If the hydraulic motor 2 is moved against the load pressure fluid is conveyed into the working pressure line 11 by the hydraulic pump 4. The ⅔ way valve 57 in the control line 56 is in its locking position; the control orifice 50 is relieved at the opening side and operates as a directional seat valve being in the locking position. The pressure built up in the working pressure line.11 is available at the pressure balance 50. The hydraulic motor 2 is moved at the selected speed as a function of the selected position of the measuring orifice 7. Excessive pressure fluid is discharged to the tank 5 by the control orifice 52 of the pressure balance 54 via the bypass line 51. Thanks to the influence of the control presures in the control lines 62 and 61 and of the spring 63 the control orifice 52 ensures the keeping constant of the difference in pressure adjusted at the measuring orifice 7 and thus a constant speed of the hydraulic motor 2. If the hydraulic motor 2 is to be stopped, the hydraulic pump 8 is shut off and also the measuring orifice 7 is also possibly brought into the shut-off position so that the control orifice 52 is opened completely until it is brought into the shut-off position after the switching off of the pump 4 by the spring 63 and the pressure in the control line 62. The load pressure is held by the non-return valve 12 and by the control orifice 50 of the pressure balance 53. The proportional magnet 8 of the measuring orifice 7 can be de-energized so that the same is opened and released from load holding tasks.

If the hydraulic motor 2 is to be moved under the load, the proportional magnet 8 is excited until the complete closing of the measuring orifice 7, the pump 4 being switched off, and then is partly de-energized again in accordance with the desired speed, so that the measuring orifice generates a certain difference in pressure for the flowing off of the pressure fluid. At the same time the ⅔ way valve 67 is switched into the passage position so that the control orifice 50 undertakes again its control function, i.e. that it lets that much pressure fluid flow into the tank via the bypass line 15' that the adjusted difference in pressure is maintained at the measuring orifice 7, viz. irrespective of the fact whether the load pressure is changed or not. If the piston 3 of the hydraulic motor 2 travels up to its lower final position, the pressure in the working pressure line would decrease to 0. As soon as the pressure in the working pressure line 11 threatens to decrease down to the amount of the opening pressure of the control orifice 50 (force of the spring 59), the biasing valve 60 is closed so that a pressure is always maintained in the working pressure line 11 and thus in the control line 55, which is higher than the opening pressure of the control orifice 50 so that its directional or control function is not lost in the ⅔ way valve 57 located in the locking position. If the hydraulic motor 2 must be stopped before it has reached its final position under load, this can either be done by means of the measuring orifice 7, which is switched into its locking position or also by means of the ⅔ way valve 57, which is switched into the locking position in a fashion advancing the locking position of the measuring orifice 7 so that the control orifice abandons its control function and takes over the directional function and stops the hydraulic motor.

The control device 1'' according to FIG. 4 operates substantially in the same manner as the control device 1'. The control pressure for the control orifice 52 of the pressure balance of the three-way flow controller, which is active in the control line 61' upon the switching off of the pump can nevertheless not open the control orifice 52, because the control pressure in the control line 62 and the force of the spring are active in the direction of closing. The biasing valve 60' is then brought into the shut-off position by the spring 65 in pressure controlled fashion in the control device 1'', if the pressure in the working pressure lines threatens to decrease. The other functions proceed as described above.

The embodiments of FIGS. 3 and 4 excel by the omission of a separate load-holding valve on the one hand and by an almost ideal, jerk-free control behaviour on the other hand. Instead of an adjustable measuring orifice 7 a fixedly adjusted measuring orifice could be provided for both pressure balances, e.g. in a loading side-board control, in which it is worked at constant speeds, adjusted right from the beginning.

I claim:

1. A hydraulic control device (1, 1', 1'') for a hydraulic motor (2) working one-sidedly against a load (F), comprising a working pressure line (11) connecting a pressure source (4) via line sections (11*a*, 11*b*) with a hydraulic motor (2) and containing a non-return valve (12) from which a bypass line (15, 15') to a tank (5) is branched off, a three-way flow controller with proportional magnetic actuation, which is connected to the tank with its control outlet, a two-way flow controller in the bypass line (15), the three-way flow controller being actuated upon non-actuated two-way flow controller for the working of the hydraulic motor against the load (F) and the two-way flow controller being actuated upon non-actuated three-way flow controller for the working of the hydraulic motor under the load for controlling the speed, and a measuring orifice (7), a pressure balance and a proportional magnet being in each case allocated to the three-way and the two-way flow controller, characterized in that a single measuring orifice (7) being common to both pressure balances (10; 53, 54) with a single proportional magnet (8) is provided in the working pressure line (11).

2. A hydraulic control device according to claim 1, characterized in that a shut-off valve (16) is provided in the bypass line (15) between the two-way flow controller and the tank (5), which is shut off for load holding and in the case of an actuation of the three-way flow controller and is opened upon the actuation of the two-way flow controller.

3. A hydraulic control device according to claim 2, characterized in that the control outlet of the three-way flow controller is connected to the tank (5) via a line (18) bypassing the shut-off valve (16).

4. A hydraulic control device according to claim 2, characterized in that the shut-off valve is actuated by a magnet.

5. A hydraulic control device according to claim 1, characterized in that the pressure balances of the two flow controllers are constructionally combined to a single pressure balance assembly and have a common piston (28) which can be acted upon on both sides with two lateral control orifice elements (29, 30) working alternately, which can be deflected in both directions of movement against spring force from a stable basic position and that the control piston (28) is loaded at its two sides to be acted upon with control pressures being proportional to the pressure before and behind the measuring orifice (7).

6. A hydraulic control device according to claim 5, characterized in that the control piston (28) is displaceable in a control bushing (20) fixed in a housing chamber (19), which has a pump inlet duct (21) connected to an annular duct (22) and a tank connection (25) being spaced from it in longitudinal direction, which form elements of the two control orifices, that the control piston (28) has a lateral inlet (29) and a control edge (30) overruning the tank connection (25), which form the other elements of the two control orifices, that the bypass line (15) leads from the annular duct (22) to a bore section (24) connected to the tank connection (25), that one side of the measuring orifice (7) is connected to the housing chamber at its side (26) adjacent to the tank connection (25) and that the other side of the measuring orifice (7) is connected to the hydraulic motor (2) and to the side (27) of the housing chamber (19) via a control line (35), which is separated by the control piston (28) from the side (26) of the housing chamber (19) which comprises the tank connection (25).

7. A hydraulic control device according to claim 6, characterized in that a double acting spring assembly (31, 32, 33, 34) is disposed in the side (27) of the housing chamber (19) and is connected with the control piston (28).

8. A hydraulic control device, in particular according to claim 1, characterized in that the pressure balance (54, 52) of the three-way flow controller is disposed in a second bypass line (51) to the tank (5) and is controlled by the pressure in the working pressure line (11) between the measuring orifice (17) and the hydraulic motor (2) and a spring (63) in direction of closing and by pressure between the pressure source (4) and the measuring orifice (7) in the direction of opening, that the pressure balance (53, 50) of the two-way flow controller disposed in the first bypass line (15') is controlled in the direction of opening by pressure between the pressure source (4) and the measuring orifice (7) and in the direction of closing by pressure between the measuring orifice (7) and the hydraulic motor (2) and a spring (59) and that in the pressure balance (53, 50) of the two-way flow controller and regulating function can be optionally replaced by a control function to take and maintain the position of closing irrespective of the position of the measuring orifice (7) during load holding and during working with the three-way flow controller.

9. A hydraulic control device according to claim 8, characterized in that the side of the pressure balance (53, 50), at which the same can be acted upon in the direction of opening, can be relieved from pressure.

10. A hydraulic control device according to claim 8, characterized in that a $\frac{2}{3}$-way valve (57) is disposed in a control line (56) to the side of the pressure balance acting upon the pressure balance (53, 50) in the direction of opening, which separates the side of the pressure balance from the control line (56) and relieves it towards the tank (5).

11. A hydraulic control device according to claim 10, characterized in that the $\frac{2}{3}$-way seat valve (57) can be switched into the shut-off position advancing the closing position of the measuring orifice (7).

12. A hydraulic control device according to claim 11, characterized in that the pressure balance with the measuring orifice (7), the proportional magnet (8) and the components provided for load holding and the operation of the control device are combined in a lifting module component (M).

13. A hydraulic control device according to claim 12 in which the non-return valve (12) is incorporated in the lifting module components.

14. A hydraulic control device according to claim 8, characterized in that a biasing valve (60, 60') is provided in the bypass line (15') from the pressure balance (53, 50) to the tank (5), which is adjusted to a minimal biasing pressure, which is higher than the opening pressure of the pressure balance determined by the spring force (59) at the pressure balance (53, 50).

15. A hydraulic control device according to claim 14, characterized in that the biasing valve (60, 60') is one which can be acted upon with the control pressure (control line 66) between the measuring orifice (7) and motor (2) against a spring (65) in such fashion that prior to the decrease of the control pressure (control line 55) acting upon the pressure balance (53, 50) in the direction of closing below the opening pressure determined by the spring force (59) acting in the direction of opening of the pressure balance that shuts off the bypass line (15') to the tank (5).

16. A hydraulic control device according to claim 1, characterized in that the pressure balance with the measuring orifice (7), the proportional magnet (8) and the components provided for load holding and the operation of the control device are combined in a lifting module component (M).

17. A hydraulic control device according to claim 16 in which the non-return valve (12) is incorporated in the lifting module component.

* * * * *